US012604985B2

(12) United States Patent
Costaglia

(10) Patent No.: US 12,604,985 B2
(45) Date of Patent: Apr. 21, 2026

(54) CHAIR FOR THE SITTING OF A USER

(71) Applicant: REXSITT ITALIA S.R.L., Bertinoro (IT)

(72) Inventor: Massimo Costaglia, Santa Giustina in Colle (IT)

(73) Assignee: REXSITT ITALIA S.R.L., Bertinoro (IT)

( * ) Notice: Subject to any disclaimer, the term of this patent is extended or adjusted under 35 U.S.C. 154(b) by 177 days.

(21) Appl. No.: 18/744,638

(22) Filed: Jun. 16, 2024

(65) Prior Publication Data

US 2025/0000268 A1 Jan. 2, 2025

(30) Foreign Application Priority Data

Jun. 29, 2023 (IT) ..... 102023000013479

(51) Int. Cl.
*A47C 7/44* (2006.01)

(52) U.S. Cl.
CPC ..... *A47C 7/441* (2013.01); *A47C 7/443* (2013.01)

(58) Field of Classification Search
CPC ..... A47C 7/441; A47C 7/443; A47C 7/444
See application file for complete search history.

(56) References Cited

U.S. PATENT DOCUMENTS 5,328,237 A 7/1994 Yamaguchi et al.
6,053,574 A * 4/2000 Opsvik ..... A47C 3/026 297/303.2
10,130,184 B2 * 11/2018 Lin ..... A47C 7/443
10,178,913 B2 * 1/2019 He ..... A47C 1/03274
10,595,636 B2 * 3/2020 Jin ..... A47C 1/03255

FOREIGN PATENT DOCUMENTS

KR 102104462 B1 * 4/2020 ..... A47C 1/03272

OTHER PUBLICATIONS

Extended European Search Report for EP 24184856.3 Mailed on Nov. 6, 2024.
Italian Search Report for IT 202300013479 Mailed on Dec. 13, 2023.

* cited by examiner

*Primary Examiner* — Joshua J Michener
*Assistant Examiner* — Michael B. Kreiner
(74) *Attorney, Agent, or Firm* — Rivka Friedman

(57) ABSTRACT

Chair comprising a support structure, to which a backrest is hinged, reclinable between an inoperative position and a reclined position, and a spring, which is connected to the backrest and to the support structure and can tensioned in a first direction, following the movement of the backrest, in order to exert an elastic return force to bring the backrest back from the reclined position into the inoperative position. The chair also comprises an adjustment device adapted to adjust the elastic return force exerted by the spring and comprising an actuation system, which is connected to the backrest, can be removably connected to the spring and is configured to tension, following the movement of the backrest, the spring in a second direction, to increase the elastic return force exerted by the spring due to the movement of the backrest from the inoperative position towards the reclined position.

10 Claims, 6 Drawing Sheets

CHAIR FOR THE SITTING OF A USER

FIELD OF APPLICATION

The present invention regards a chair for the sitting of a user.

The present chair is intended to be employed for allowing the sitting of a user, for example in offices, ateliers and the like (in particular during working hours) as well as in private homes, e.g. in respective studies, kitchens or living rooms.

The present chair is advantageously of reclinable type, so as to allow a user to vary the sitting position thereof between a first position in which the back is placed substantially at right angle with respect to the legs, and multiple reclined positions.

The chair, object of the present invention, is therefore inserted in the field of furnishing of both work and home environments, and more generally in the field of furniture production, in particular in the production of chairs and seats that are reclinable.

STATE OF THE ART

So-called adjustable chairs are known in the technical field of furnishing, which are susceptible of being adjusted during their use so as to be adapted to the different needs of the user both in anatomic terms and in terms of requested use type.

More in detail, the adjustable chairs usually have a height-adjustable sitting, so as to be adapted to the stature of the user who uses it, and a reclinable backrest, so as to allow the user to take on a classic seated position, in which the back is erect and orthogonal to the upper portions of the legs, as well as multiple reclined positions in which the back is tilted back and the user takes on an inoperative position, more extended with respect to the classic seated position.

The chairs of known type with reclinable backrest comprise a support base, which is intended to be abutted against the ground, and a backrest which is hinged to the support base and is reclinable, against the action of a return spring, between an inoperative position and multiple reclined positions. In particular, the return spring is mounted on the support base and is connected at a first end thereof to the same base and at an opposite second end to the backrest, so as to determine an elongation of the spring during the reclining of the backrest, such to exert an elastic return force in order to bring the backrest back from the reclined position to the inoperative vertical position. Such chairs also comprise a seat, which is intended to support a user in seated position, is fixed to the backrest and is slidably connected to the support base in order to slide with respect to the latter when the user reclines the backrest from the inoperative position.

Nevertheless, the chairs of known type described above have in practice shown that they do not lack drawbacks.

A first drawback lies in the fact that such chairs are not adaptable to the different types of users and to the respective anatomic shapes. More in detail, such chairs of known type are usually designed on the basis of a user of medium build, and are therefore not very comfortable if employed by users who have a smaller or greater build with respect to the standard user.

Indeed, the users of smaller build are subjected to a high resistance of the backrest when they try to recline the backrest and a consequent high return force of the backrest in order to return into the return position, while the users of greater build sustain a reduced resistance to the same backrest and a consequent reduced return force of the latter.

In this situation, therefore, the chairs of known type are not very comfortable for the users who have a slender or robust build, which differs from a medium build for which the chairs of known type are suitably designed.

In order to overcome such drawback, chairs have been developed which allow adjusting the tension of the spring in order to vary the response of the backrest and adapt the chair to multiple types of users. More in detail, such chairs comprise loading means, adapted to vary the loading of the elastic spring. The loading means of the chairs of known type comprise a threaded tensioning element, which is mounted on the support base, is connected to the first end of the return spring and is provided with an actuation portion, engageable by a tool. In particular, the spring is provided at the first end thereof with a connection element, which is fixed to the spring and is partially screwed to the tensioning element.

In operation, during use, the user inserts a tool (which can also be pre-mounted) on the actuation portion of the tensioning element, in order to screw the latter on the connection element mounted on the first end of the spring, determining an elongation of the latter and thus a preloading of the spring itself.

In other words, by means of such actuation of the tensioning element, the user adjusts the elastic force that the spring exerts on the backrest following its reclining between the inoperative position and the various reclined positions, so as to adapt the chair to the personal comfort and build needs of the user.

Nevertheless, also such type of chair of known type has in practice shown that it does not lack drawbacks.

The main drawback lies in the fact that such loading means are extremely cumbersome and difficult to actuate by a user.

Indeed, such loading means directly act on the elastic spring in order to vary the extension of the spring and hence the return force that it exerts on the backrest in order to bring it back from a reclined position in the inoperative position. In such a manner, however, the user must exert a high loading force, which is in particular proportional to the extension of the spring and is extremely arduous for adjustments that stiffen the backrest.

In addition, such adjustment action is extremely inconvenient since it must be carried out each time chair is used by a different a user, determining an annoying adjustment operation at the start of each use session.

In addition, such loading system is extremely inconvenient since it requires the user to precisely indicate the tool and is difficult to carry out when the user is in seated position, during the use of the chair.

A further drawback lies in the fact that the adjustment means of known type require a prolonged action in terms of time, which is usually due to a high number of revolutions necessary for varying, by a significant value, the elastic spring so as to perceive an actual difference in the thrust and response of the backrest.

A further drawback lies in the fact that such adjustment means of known type usually require the use of a suitable tool, so as to allow the adjustment of the tension of the spring.

PRESENTATION OF THE INVENTION

In this situation, the problem underlying the present invention is therefore that of overcoming the drawbacks set forth by providing a chair for the sitting of a user that allows adjusting, in a simple and easy manner, the elastic response of the backrest when it is reclined, in particular without the need to use a high adjustment force.

A further object of the present invention is to provide a chair for the sitting of a user which allows adjusting, in a rapid manner, the elastic response of the backrest when it is reclined.

A further object of the present invention is to provide a chair for the sitting of a user which allows an easy adjusting, even in seated position, for the different types of users.

A further object of the present invention is to provide a chair for the sitting of a user which is comfortable during its use, in particular regardless of the build of the user whose uses it.

A further object of the present invention is to provide a chair for the sitting of a user which is resistant and easily adjustable even after various adjustment and use cycles.

A further object of the present invention is to provide a chair for the sitting of a user which is safe during its use.

A further object of the present invention is to provide a chair for the sitting of a user which is simple and inexpensive to attain.

BRIEF DESCRIPTION OF THE DRAWINGS

The technical characteristics of the invention, according to the aforesaid objects, and the advantages thereof, will be more evident from the following detailed description, made with reference to the enclosed drawings, which represent a merely exemplifying and non-limiting embodiment of the invention, in which.

DETAILED DESCRIPTION OF A PREFERRED EMBODIMENT

Figures 1A, 1B:
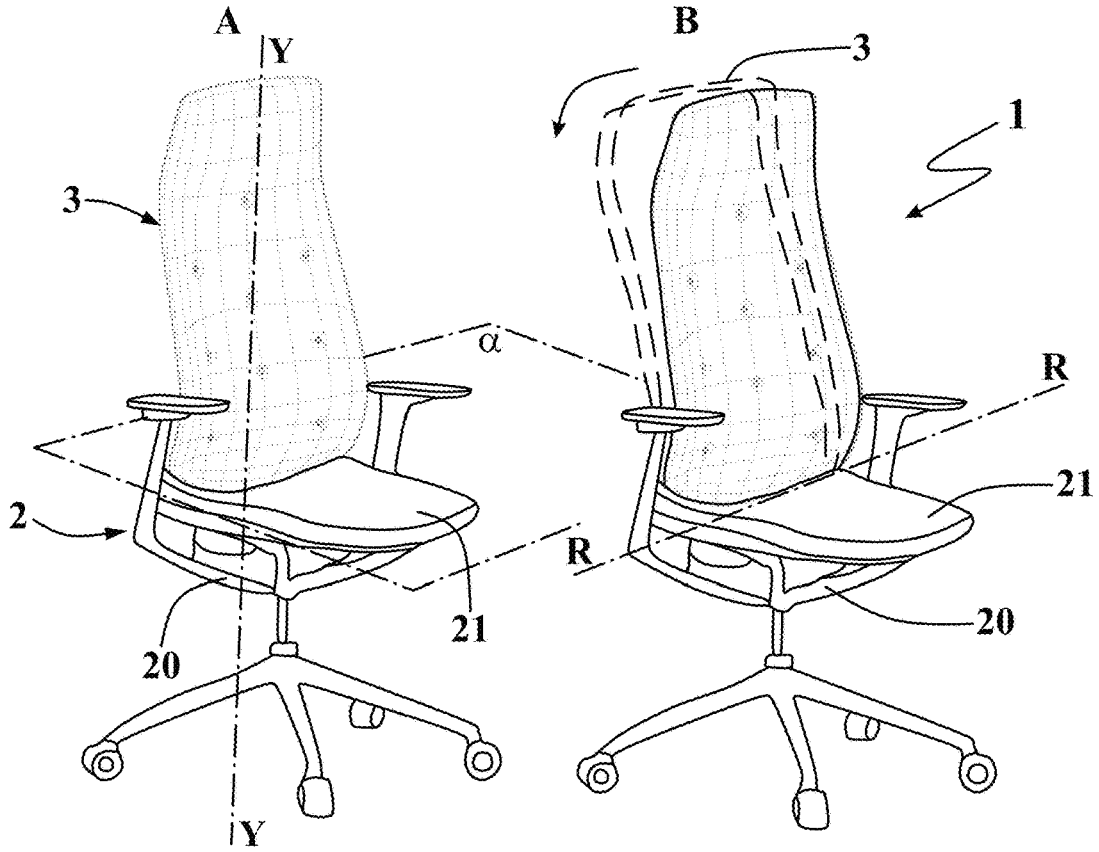
FIGS. 1A and 1B illustrate a side view of a chair for the sitting of a user, object of the present invention, respectively with the backrest in an inoperative position and in a reclined position.

With reference to the enclosed drawings, reference number 1 overall indicates the chair for the sitting of a user, object of the present invention.

Advantageously, the present chair 1 is adapted to be placed as a furnishing element in both public and private environments, work and home environments.

More in detail, the chair 1, object of the present invention, is intended to be advantageously used for the sitting of a user, for example for the sitting of a worked in an office, or for the sitting of a user in a private and/or home setting.

In particular, the chair 1, object of the present invention, is of reclinable type, so as to allow a user to vary his/her own sitting position between a first position, e.g. an operative position in which the back is placed substantially at right angle with respect to the legs, and multiple reclined positions, substantially for relaxation, in which the back is tilted with respect to the legs and the user takes on a more laid-back position with respect to the aforesaid operative position.

The chair 1 for the sitting of a user, object of the present invention, comprises a support structure 2, intended to be placed on the ground and to support a user in seated position.

In particular the support structure 2 comprises a base 20, intended to be placed on the ground.

Advantageously, the base 20 of the chair 1 comprises multiple support legs which are preferably provided with wheels for allowing the movement of the chair 1 on the floor during its use.

Of course, it is also possible to provide for a base 20 of foundation type, without support legs, or provide for a base 20 in which the legs lacking wheels, so as to allow greater stability in the position of the chair 1 during its use.

Preferably, the base 20 of the chair 1 is made of resistant material and in particular of metal material, such as for example steel or aluminum, or alternatively of plastic material.

The chair 1 also comprises a backrest 3, hinged to the support structure 2, around a first hinging axis R and which is reclinable around the first hinging axis R between an inoperative position A and at least one reclined position B, preferably a plurality of reclined positions B.

In particular, the backrest 3 is reclinable back so as to allow the user to take on a more extended position than a classic seated position, in which the back is placed substantially at right angle with respect to the legs.

Advantageously, the backrest 3 is hinged to the support structure 2 at a hinging pivot C, in which a pin is inserted, and is rotatable around the first hinging axis R, passing through the aforesaid hinging pivot C, between the inoperative position A and the different reclined positions B.

More in detail, as better described hereinbelow, the backrest 3 is extended along a main extension direction Y, projecting from the support structure 2, and such main extension direction Y is placed substantially vertically when the backrest 3 is situated in the inoperative position, and is instead tilted with respect to the vertical when the backrest 3 is moved into the aforesaid reclined positions. Preferably, the main extension direction Y of the backrest 3 is substantially orthogonal to the first hinging axis R.

More in detail, the main extension direction Y is to be intended as the main direction along which the backrest 3 is extended, apart from possible curvature present in the backrest 3 and adapted to define for example portions of backrest 3 with improved ergonomics.

Indeed, for example as is visible in the enclosed figures, the backrest 3 has a substantially curved extension and defines, in a per se known manner, a portion for the lumbar support of the back of the user during use of the chair 1.

Advantageously, the support structure 2 also comprises a seat 21, which is mechanically constrained to the backrest 3, defines a lying plane $\alpha$ and is intended to support a user in seated position on the aforesaid lying plane $\alpha$.

Of course, also in such case it is possible that the seat 21 will not be perfectly planar, and is more or less convex depending on the different geometries and types of materials employed, and in such case with the expression lying plane it will be intended the sitting plane ideally defined by the seat 21, as better visible in FIGS. 1A and 1B.

More in detail, the lying plane α defined by the seat 21 is transverse to the backrest 3 and is preferably substantially orthogonal to the main extension direction Y of the latter when the backrest 3 is situated in the inoperative position. In particular, the main extension direction Y of the backrest 3 defines, with the aforesaid lying plane α, a reclining angle which progressively increases as the backrest 3 is reclined from the inoperative position towards the reclined positions. The chair 1 is also provided with an elastic return system 4, comprising a spring 40, which extends between a first end 40' mechanically connected to the backrest 3 and a second end 40" mechanically connected to the support structure 2.

Figure 8A:
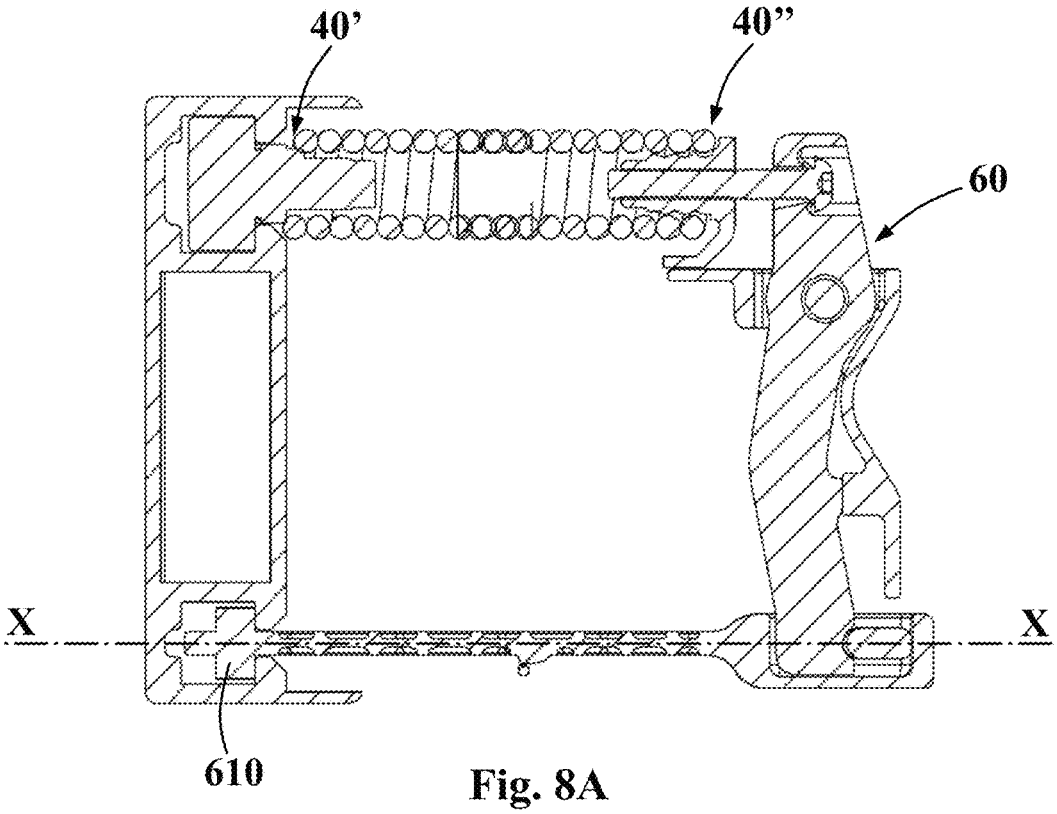
FIGS. 8A and 8B illustrate a top section view of the adjustment device of FIG. 7A, with the backrest respectively in inoperative position and reclined position.
Figure 8B:
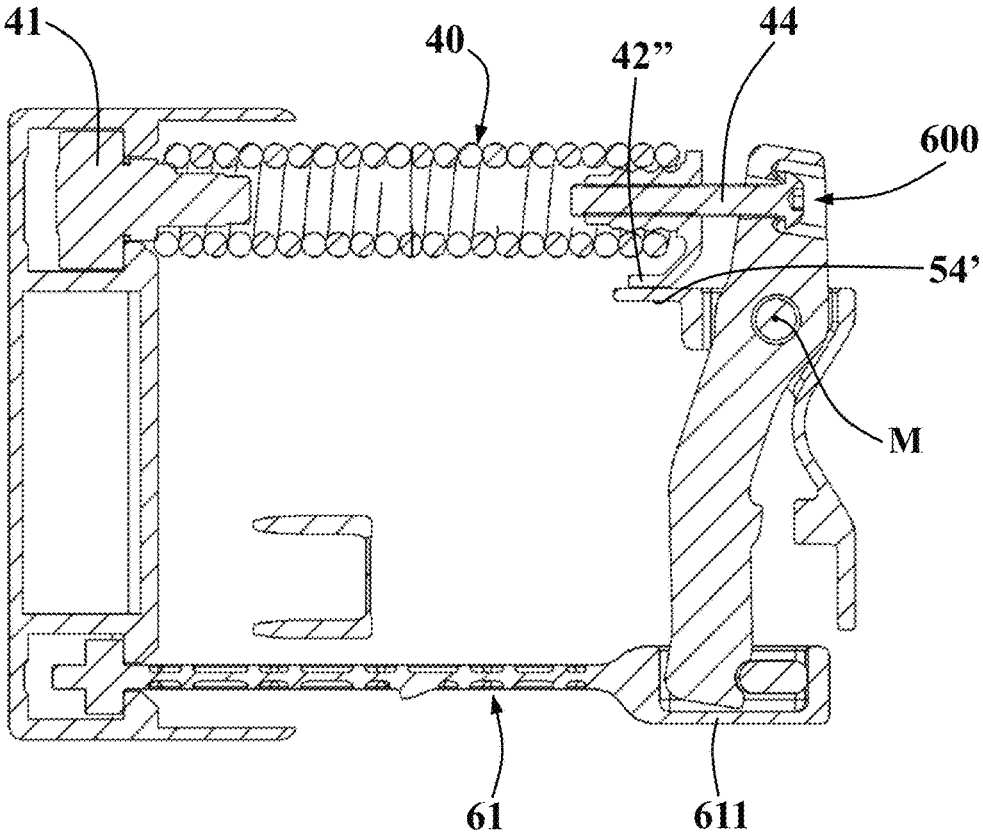

The spring 40 is arranged to be tensioned, at the first end 40' thereof, along a tensioning direction T in a first direction V1, following the movement of the backrest 3, and to exert a corresponding elastic return force, in order to bring the backrest 3 back from the reclined position B to the inoperative position A, as visible respectively in FIGS. 8B and 8A.

Figure 2:
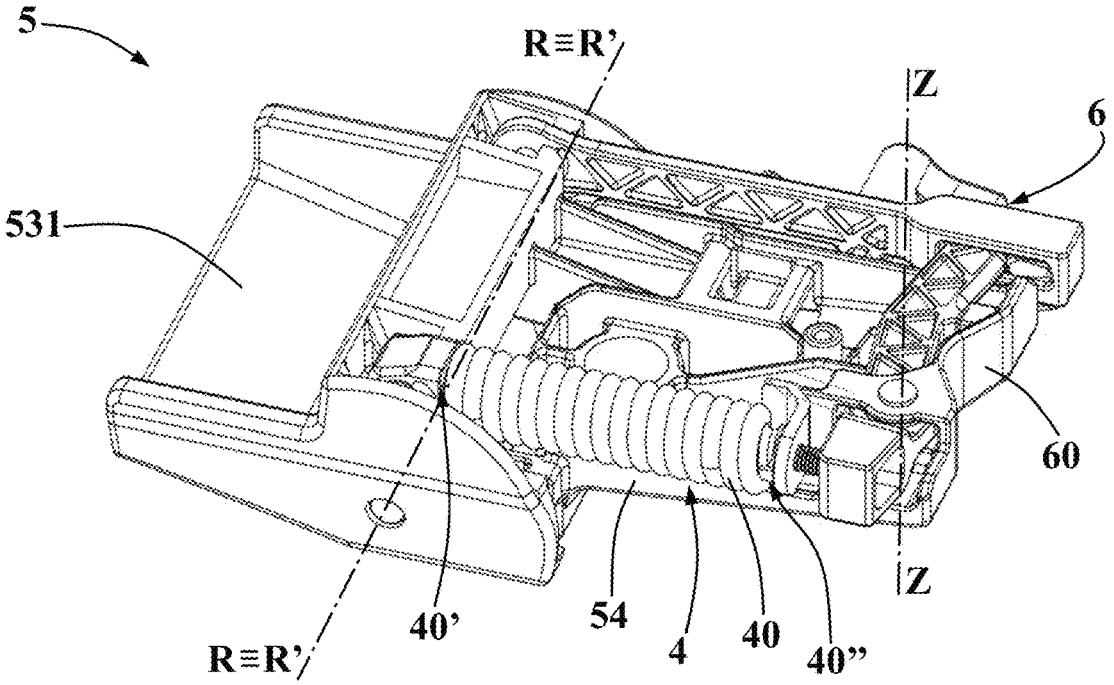
FIG. 2 illustrates a top perspective view of a detail of the chair of FIG. 1, relative to an adjustment device.

According to the idea underlying the present invention, the chair 1 is provided with an adjustment device 5, which is mechanically connected to the backrest 3 and to the support structure 2, is adapted to adjust the elastic return force exerted by the spring 40, and comprises an actuation system 6, mechanically connected to the backrest 3 and removably connected to the second end 40" of the spring 40, as visible in FIG. 2.

In particular, the adjustment device 5 advantageously comprises a first support 53, fixed to the backrest 3 and integral in rotation with the latter, and a second support 54, connected to the support structure 2 and hinged to the first support 53 around a rotation axis (by means of a pin 534) preferably coinciding with the first hinging axis R.

Figure 9A:
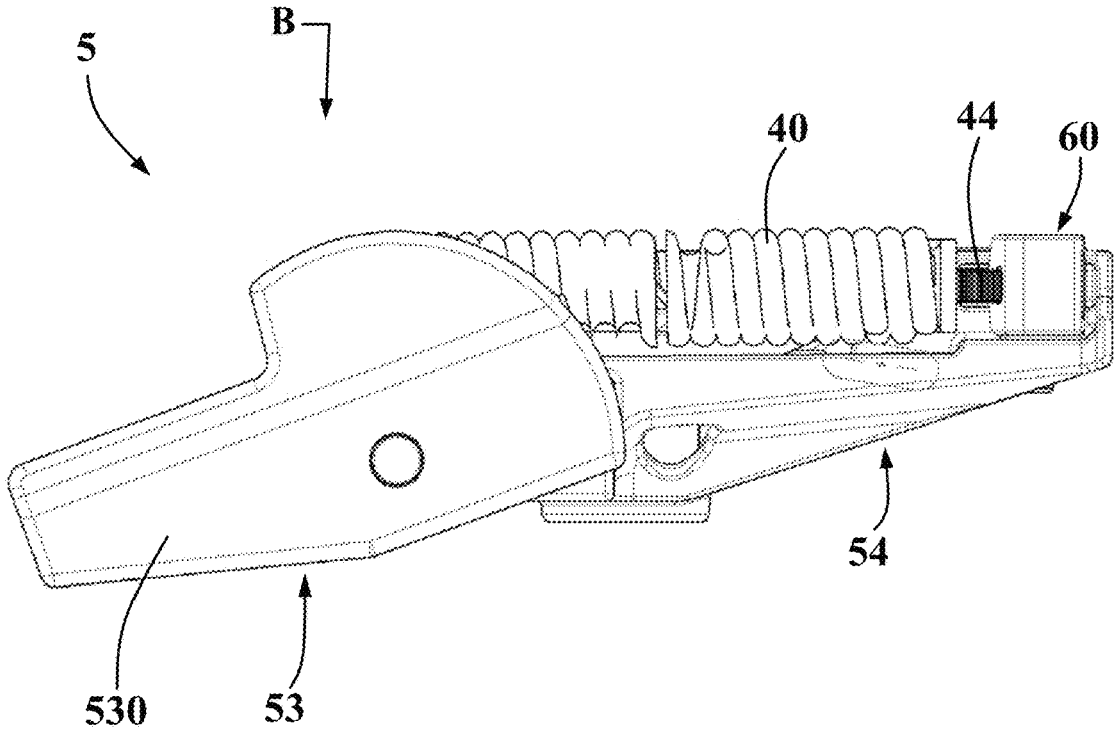
FIGS. 9A and 9B illustrate a side view of the adjustment device respectively of FIGS. 8B and 8A.
Figure 9B:
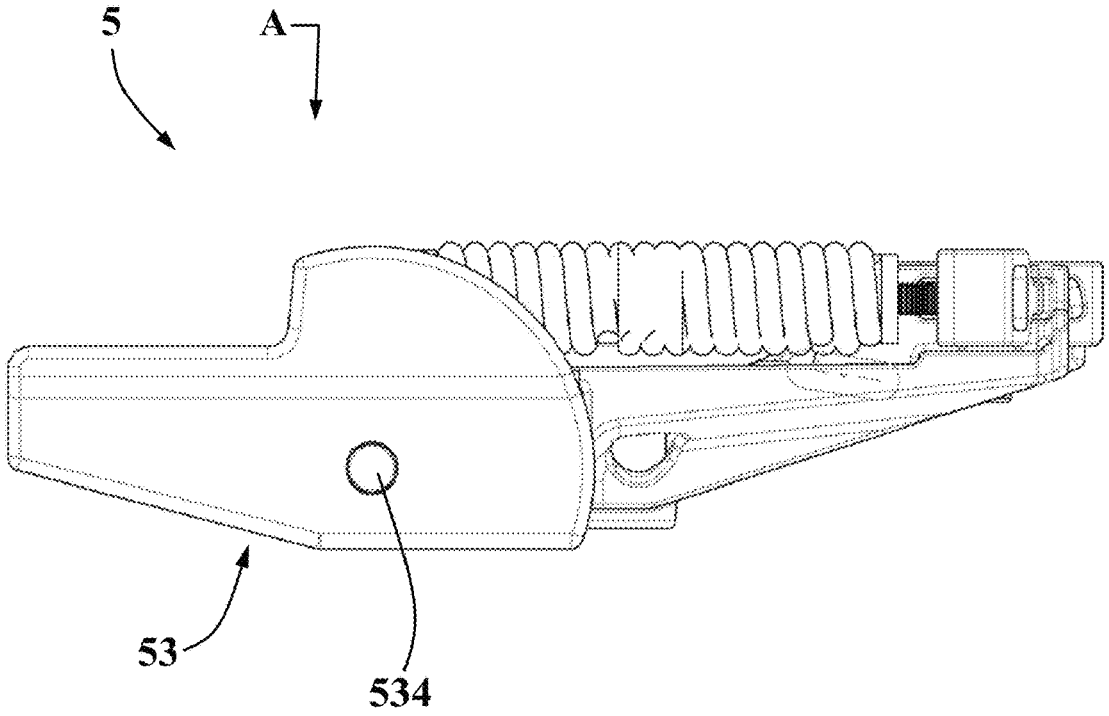

Advantageously, in inoperative position A, the first support 53 and the second support 54 between them for an angle that is substantially flat (equal to 180°), as is visible in FIG. 9A, while in the reclined position B such angle is greater than 180°, as is visible in FIG. 9B.

Advantageously, the first support 53 has a substantially L-shaped body, and is preferably provided with two opposite lateral walls 530, and a central connection wall 531, placed to connect the two lateral walls 530 and substantially parallel to the seat 21 in the inoperative position A, and on such connection wall 531 the backrest 3 is preferably fixed.

Preferably the second support 54 is mounted above the base 20 of the support structure 2, below the seat 21. Preferably, the first support 53 and the second support 54 are made of aluminum.

Advantageously, the first end 40' of the spring 40 is mechanically connected to the first support 53 and the second end 40" of the spring 40 is mechanically connected to the second support 54. More in detail, the first end 40' of the spring 40 is advantageously engaged with the first support 53, preferably via shape coupling. In particular, on the first support 53, an engagement seat is made, and the first end 40' of the spring 40 is housed in the engagement seat, where it is advantageously constrained along the tensioning direction T.

Advantageously, the elastic return system 4 is provided with a first engagement element 41, which is fixed to the first end 40' of the spring 40, e.g. via screwing, and which is preferably housed in the aforesaid engagement seat.

According to the present invention, the actuation system 6 is configured to tension, following the movement of the backrest 3, the spring 40 at the second end 40" thereof along the tensioning direction T in a second direction V2 opposite the first direction V1, in order to increase the elastic return force exerted by the spring 40 due to the movement of the backrest 3 from the inoperative position A towards the reclined position B.

In operation, during use, a user reclines the backrest 3 by rotating it from the inoperative position A towards the reclined position B. During such movement of the backrest 3, therefore, the spring 40 is retracted, at its first end 40', along the tensioning direction T in the first direction V1.

Consequently, the spring 40 generates a first elastic return force Fr1, with modulus equal to the first tensioning force Ft1, and oriented along the tensioning direction T in the second direction V2, in order to bring the backrest 3 back from the reclined position B to the inoperative position A. In such situation, the actuation system 6, also being mechanically constrained to the backrest 3, is moved with the latter along a movement direction thereof, preferably substantially parallel to the tensioning direction T of the spring 40. The movement of the actuation system 6, which as described above is connected to the second end 40" of the spring 40, causes the spring 40 to be retracted, along the tensioning direction T, in a second direction V2 opposite the first direction V1. This determines that the spring 40 generates a second elastic return force Fr2, that is opposed to the reclining of the backrest 3 and is in particular proportional to the reclining of the latter around the first hinging axis R, as is visible in FIG. 4.

In this manner it is possible to generate a greater elastic return force given the same reclining angle of the backrest 3, hence able to support users with higher weight, or, given the same peso, tilts of the backrest 3 that are greater than the chairs of the prior art.

In this manner, it is also possible to uniformly elongate the spring 40 of the elastic return system 4 from both ends 40', 40", preventing the deformation of any one section the spring 40 and ensuring high durability of the chair 1.

In addition, as set forth above, the actuation system 6 is removably connected to the second end 40" of the spring 40, such that it can be connected and disconnected depending on the user needs, as is better described hereinbelow. This allows the user to select whether to employ the chair in a harder configuration, i.e. in which he/she will receive from the spring 40 a greater elastic return force given the same applied reclining, or on the contrary a softer configuration, i.e. in which he/she will receive a lower elastic return force from the spring 40 given the same applied reclining. More in detail, the adjustment device 5 is configured to operate in a maximum resistance configuration, in which the second end 40" of the spring 40 is tensionable in order to exert a greater elastic return force, and a minimum resistance configuration, in which the second end 40" of the spring 40 is fixed in order to exert a lower elastic return force.

In this manner, it is also possible to adjust the capacity of the spring 40 to exert a greater or lower elastic return force depending on the user type (heavier or lighter) and/or the need of the user to take on a more or less relaxed posture. Indeed, with the maximum resistance configuration, the spring 40 will tend to more rapidly bring the backrest 3 back to inoperative position A, forcing the user to remain with the back substantially straight or adherent to the backrest 3, while with the minimum resistance configuration, a user can recline the backrest 3 more easily and longer in the reclined positions B.

Advantageously, the adjustment device 5 comprises a removable hooking system 7, connected to the actuation system 6 and movable between a hooking position, in which it is placed to connect between the second end 40" of the spring 40 and the backrest 3, and an unhooking position, in which it mechanically unhooks the second end 40" of the spring 40 from the backrest 3.

Advantageously, in the hooking position, the adjustment device 5 operates in the maximum resistance configuration, in which it is possible to tension the spring 40 from both ends 40', 40", while in the unhooking position, the adjustment device 5 operates in the minimum resistance configuration, in which the spring 40 is only tensioned at its first end 40'.

In this manner, the removable hooking system 7 advantageously allows a user to easily pass between the two configurations of the adjustment device 5 without having to install further components on the chair 1 or execute complex adjustment operations.

Advantageously, the actuation system 6 comprises at least one motion transformation member 60 placed to mechanically connect between the backrest 3 and the second end 40" of the spring 40. In particular, the motion transformation member 60 is advantageously configured to transform the rotary motion due to the rotation of the backrest 3 around the first hinging axis R, into a rectilinear motion of the second end 40" of the spring 40, in particular along the tensioning direction T.

In particular, in the minimum resistance configuration, the motion transformation member 60 does not act on the spring 40, which will therefore only be elongated from the first end 40' thereof, along the tensioning direction T, in the first direction V1, in a manner proportional to the rotation of the backrest 3, according to a proportionality coefficient dependent on the elastic constant of the spring 40 and on the capacity of rotating the backrest 3.

Advantageously, in the maximum resistance configuration, following a rotation of the backrest 3 around the first hinging axis R, the motion transformation member 60 advantageously causes an additional elongation of the spring 40 in the second direction V2, along the tensioning direction T. In particular, given the same rotation angle of the backrest 3, the ratio between the total elongation of the spring 40 in the maximum resistance configuration and the total elongation of the spring 40 in the minimum resistance configuration is preferably comprised between 1.1 and 1.3.

In other words, the activation of the actuation system 6 advantageously allows increasing the elastic return force by a percentage comprised between 10% and 30%, preferably equal to 20%. According to the preferred embodiment of the present invention, the motion transformation member 60 is rotatably pivoted on the support structure 2, around a rotation axis Z substantially orthogonal to the tensioning direction T and to the first hinging axis R.

More in detail, the motion transformation member 60 is rotatably pivoted on the second support 54 which is connected, preferably fixed, to the support structure 2.

Advantageously, the second support 54 is a substantially box-like body, provided with a concavity that defines a containment volume at its interior. Advantageously, the second support 54 comprises a base wall 540, directed towards the floor on which the chair 1 abuts, a perimeter wall 541 extended from the lateral edges of the base wall 540, orthogonal to the latter, and preferably at least one closure portion 542, parallel to the base wall 540 and extended projecting from the perimeter wall 541.

Advantageously, as set forth above, the motion transformation member 60 is pivoted on the second support 54, for example by means of a second pin 543, which extends passing between the base wall 540 and the closure portion 542, through the containment volume.

Advantageously, the actuation system 6 comprises a thrust arm 61, which is mechanically connected to the backrest 3 and is slidable along a sliding direction X substantially parallel to the tensioning direction T of the spring 40 followed by the rotation of the backrest 3.

More in detail, the thrust arm 61 is integral with the backrest 3, during its reclining between the inoperative position A and the various reclined positions B, so as to be moved along the aforesaid sliding direction X.

Advantageously, the thrust arm 61 is mechanically constrainable, preferably in a removable manner, to the motion transformation member 60 in order to tension the second end 40" of the spring 40 by means of the motion transformation member 60.

Figure 5:
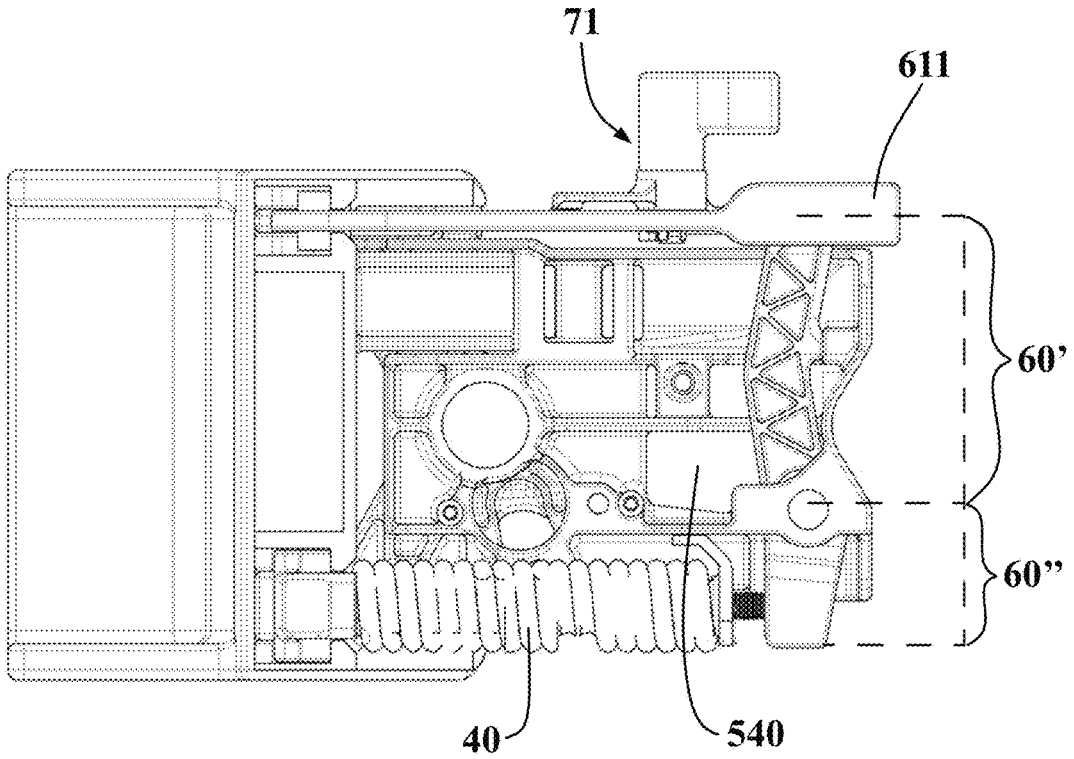
FIG. 5 illustrates a further top view of the adjustment device of FIG. 2, with the backrest in inoperative position.

Advantageously, the motion transformation member 60 is pivoted on the support structure 2 at a hinging point M and comprises a first arm 60' which extends between the hinging point M and the thrust arm 61, and a second arm 60", which extends between the hinging point M and the second end 40" of the spring 40, as visible in FIG. 5.

Figure 6:
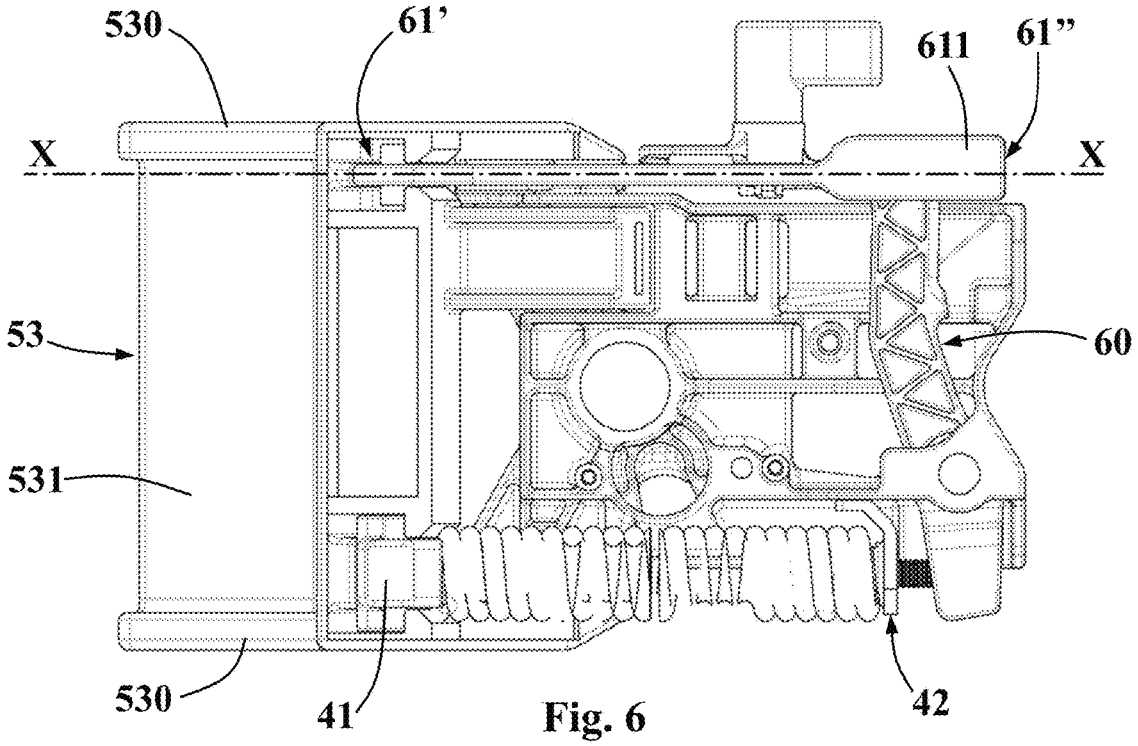
FIG. 6 illustrates a further top view of the adjustment device of FIG. 2, with the backrest in reclined position.

The first arm 60' is provided with a greater extension with respect to the second arm 60", in order to determine a sliding of the second end 40" of the spring 40 along the tensioning direction T smaller than the sliding of the thrust arm 61 along the sliding direction X, as visible in FIGS. 5 and 6.

In this manner the motion transformation member 60 is substantially constituted by a rocker arm body, which advantageously acts as a first-class lever.

Advantageously, the thrust arm 61 is indirectly connected to the backrest 3, being mounted on the first support 53 of the adjustment device 5. Preferably, the thrust arm 61 is pivoted on the backrest 3, and in particular pivoted on the first support 53 of the adjustment device 5 connected to the backrest 3, so as to allow a movement that is substantially rectilinear (along the sliding direction X) following a rotation movement of the backrest 3.

Figure 3:
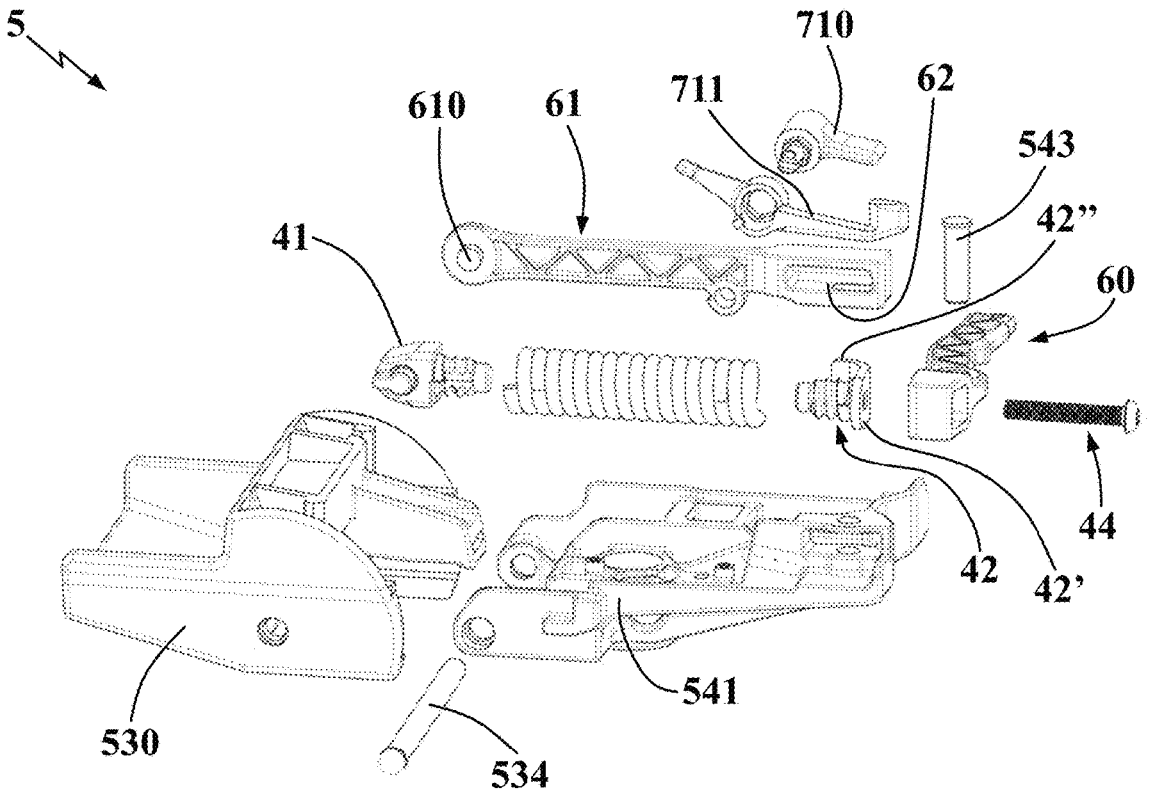
FIG. 3 illustrates an exploded view of the adjustment device of FIG. 2.
Figure 4:
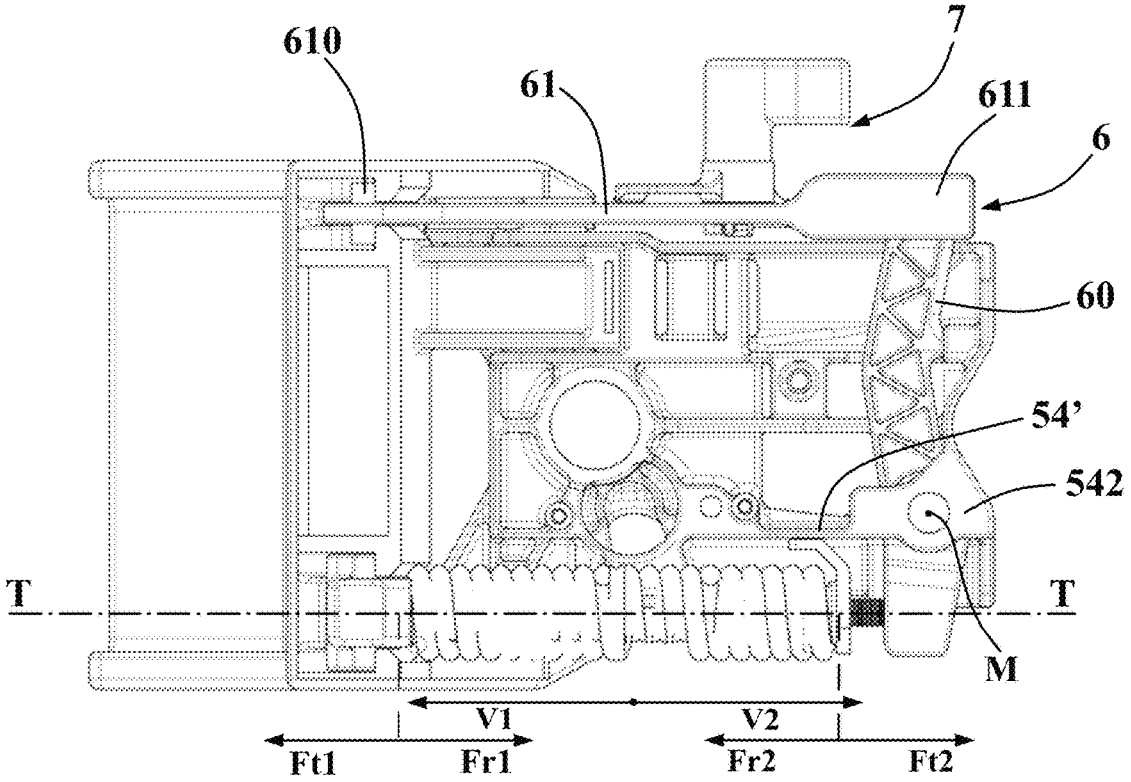
FIG. 4 illustrates a top view of the adjustment device of FIG. 2.

Advantageously, first support 53 of the adjustment device 5 is provided with at least one hinging seat, and the thrust arm 61 is pivoted in the aforesaid hinging hole by means of a pin 610 which is preferably integrally made with the thrust arm 61 itself, as is visible in FIGS. 3 and 4.

Preferably, the pin 610 is housed with clearance within the hinging seat of the first support 53, in order to allow a clearance for the thrust arm 61 necessary for preventing the breakage or deformation of the different components during the rotation of the backrest 3.

Advantageously, the thrust arm 61 is a rod-like element, which mainly extends along the sliding direction X between a first end 61' thereof mechanically connected to the first support 53, and an opposite second end 61" mechanically connected to the motion transformation member 60, in a manner such to connect the latter indirectly to the second support 53 (and to the backrest 3).

In particular, pin 610 is made at the first end 61' of the thrust arm 61, and extends projecting from at least one lateral wall of the thrust arm 61.

Advantageously, the thrust arm 61 is housed at least partially, preferably mainly, within the containment volume of the second support 54.

Advantageously, one between the adjustment device 5 and the support structure 2 is provided with one or more guides (not depicted), arranged for limiting the vertical displacements of the thrust arm 61 along a vertical axis, parallel to the rotation axis Z.

Advantageously, one between the thrust arm 61 and the motion transformation member 60 is provided with a sliding seat 62, and the other between the thrust arm 61 and the motion transformation member 60 is slidably inserted with clearance in the sliding seat 62, at least with the adjustment device 5 in the minimum resistance configuration.

Advantageously, moreover, the clearance extends parallel to the sliding direction X and is configured for allowing the free sliding of one between the thrust arm 61 and the motion transformation member 60 in the sliding seat 62 when the backrest 3 is rotated between the inoperative position A and the reclined position B.

More in detail, the housing with clearance of one between the thrust arm 61 and the motion transformation member 60 in the sliding seat 62 allows disconnecting the two elements (thrust arm 61 and motion transformation member 60) during the movement of the backrest 3, as is better described hereinbelow.

Preferably, the sliding seat 62 is made on the thrust arm 61, in particular at the second end 61" of the latter.

More in detail, the thrust arm 61 is provided with an enlarged head 611, and the sliding seat 62 is made passing through the lateral walls of the enlarged head 611.

Advantageously, in the inoperative position A, the motion transformation member 60 is partially housed within the sliding seat 62 and is placed in abutment against a stop wall of the thrust arm 61 which laterally defines the sliding seat 62, in a manner such that the clearance extends away from the first support 53.

Figure 7A:
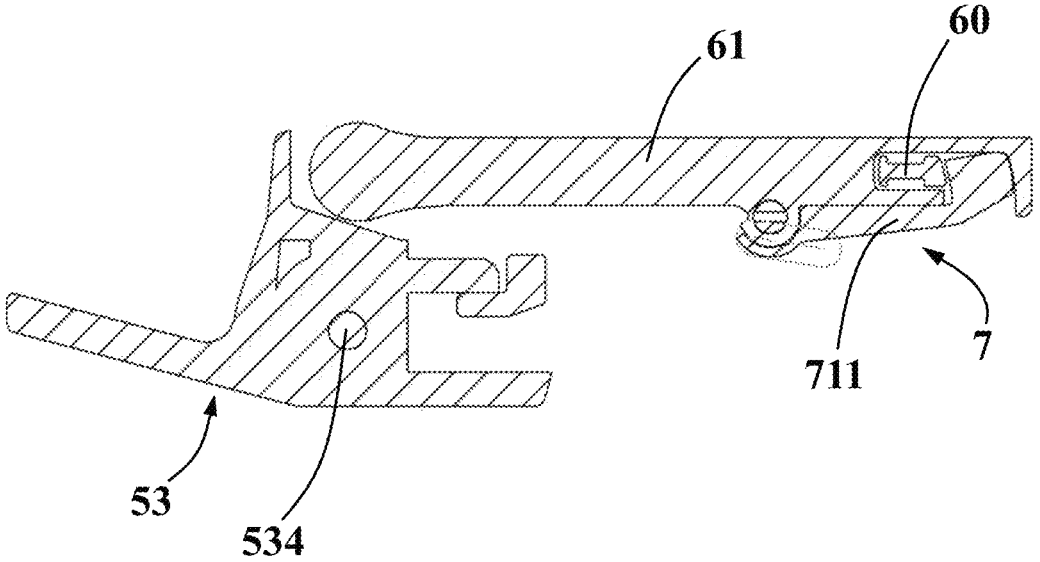
FIG. 7A illustrates a partial section view of the adjustment device of FIG. 4, with a removable hooking system in hooking position.
Figure 7B:
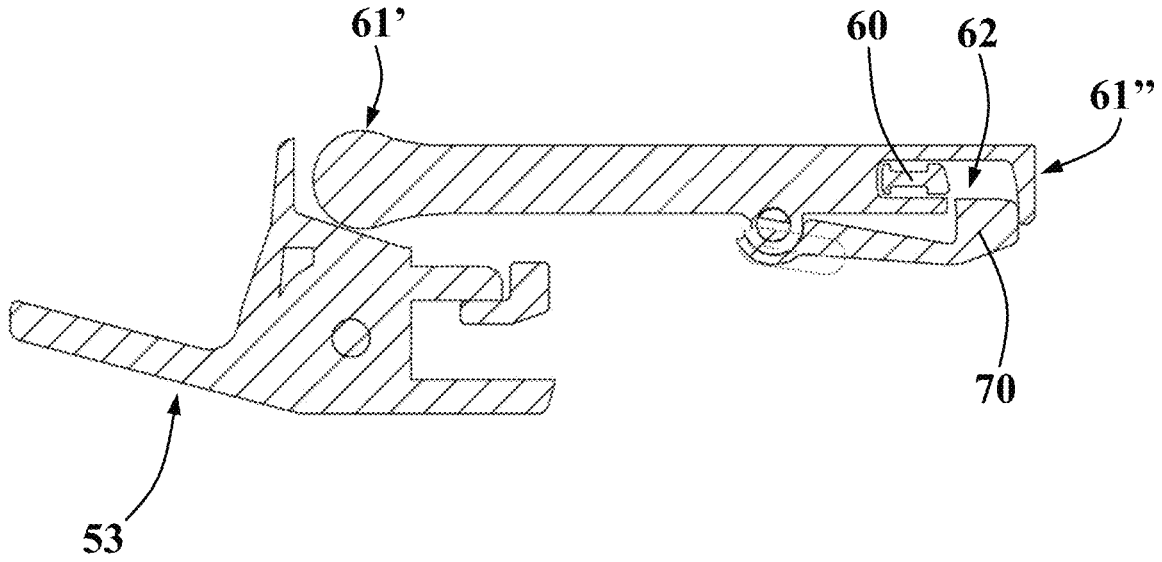
FIG. 7B illustrates a partial section view of the adjustment device of FIG. 4, with the removable hooking system in unhooking position.

In other words, the motion transformation member 60 is housed in the sliding seat 62 such to define the clearance that is placed towards the second end 61" of the thrust arm 61, as is visible in FIG. 7B. In this manner, the movement of the thrust arm 61 along the sliding direction X will not determine the immediate movement of the motion transformation member 60, and hence of the second end 40" of the spring 40, the two elements not being immediately connected along such sliding direction X. Of course, in such case it is intended that the two elements are mechanically disconnected and released along such sliding direction X during the normal use of the chair 1, for the normal reclining to which the seat 3 is subjected, it being well intended that beyond such reclining, the two elements would interact, the thrust arm 61 being potentially moved beyond the width of the clearance defined in the sliding seat 62.

Advantageously, the sliding seat 62 is sized in a manner such that a maximum rotation of the first support 53 corresponds with the maximum translation of the thrust arm 61, without this actively acting on the motion transformation member 60.

In operation, in the maximum resistance configuration, following a rotation of the backrest 3 from the inoperative position A to the reclined position B, the first support 53 of the adjustment device 5 rotates around the second hinging axis R', driving therewith the thrust arm 61 along the tensioning direction X. The thrust arm 61, being constrained to the motion transformation member 60, in turn translates the latter along the sliding direction X under the action of the first tensioning force, and at the same time generates a bending moment on the aforesaid motion transformation member 60. Such motion transformation member 60, being provided with a degree of freedom in rotation, rotates around the rotation axis Z, transmitting such moment to the second end 40" of the spring 40, which in turn reacts and translates along the tensioning direction T in the second direction V2 (being prevented from rotating as discussed more in detail hereinbelow). As set forth above, the first arm 60' is longer than the second arm 60", in a manner such to maximize the aforesaid moment and allow more greatly elongating the spring 40 in the second direction V2.

Advantageously, the enlarged head 611 is provided, at a bottom wall thereof, with an insertion opening, engageable by the removable hooking system 7 described more in detail hereinbelow.

In particular, the insertion opening is placed at the position of the clearance, when the backrest 3 is situated in the inoperative position A, so as to allow the removable hooking system 7, once inserted in the sliding seat 62, to occupy the clearance between the motion transformation member 60 and a lateral wall of the thrust arm 61 which laterally defines the sliding seat 62.

Advantageously, the motion transformation member 60 is constituted by a prismatic body with elongated shape, preferably with quadrangular section, which extends transverse to the tensioning direction T.

Advantageously, the motion transformation member 60 is provided, on the second arm 60", with an engagement hole 600, substantially made at the opposite end with respect to the hinging point M. In particular, the engagement hole 600 has a non-circular form, preferably slotted.

Advantageously, the elastic return system 4 is provided with a second engagement element 42, which is mechanically fixed to the second end 40" of the spring 40, e.g. via screwing, and which is advantageously provided with a coupling wall 42', directed towards the motion transformation member 60, on which a screwing hole is made.

Advantageously, the screwing hole is aligned with the engagement hole 600, and the elastic return system 4 preferably comprises an adjustment screw 44, placed to traverse the engagement hole 600 (in abutment against a wall of the motion transformation member 60) and screwed to the second engagement element 42, in order to mechanically connect the motion transformation member 60 and the second end 40" of the spring 40. In particular, the head of the adjustment screw 44 is placed in abutment against the rotation wall of the motion transformation member 60 and is free to slide along the slotted opening during the rotation of the motion transformation member 60. Advantageously, the adjustment screw 44 is accessible by a user such to be able to screw or unscrew the adjustment screw 44 and adjust the tension of the spring 40, for example by means of an Allen wrench. Preferably, the tension of the spring 40 is executed when the backrest 3 is in the inoperative position A.

Advantageously, the second engagement element 42 is provided with a guide wall 42", which extends preferably orthogonal to the coupling wall 42', and the second support 54 is provided with an internal abutment wall 54', which extends partially within the containment volume, starting from the perimeter wall 541, parallel to the tensioning direction T and is intended to abut against the guide wall 42" of the second engagement element 42 in order to prevent the second end 40" of the spring 40 from rotating and bending the spring 40 itself. Therefore, during the rotation of the motion transformation member 60, the movement of the spring 40 is only linear, along the tensioning direction T.

Advantageously, the removable hooking system 7 comprises an engagement element 70 which, with the removable hooking system 7 in the hooking position, is at least partly placed in the sliding seat 62 in order to occupy the clearance (preferably fully occupy) and constrain the motion transformation member 60 and the thrust arm 61.

More in detail, with this it is intended that when the removable hooking system 7 is inserted in the sliding seat 62, the motion transformation member 60 and the thrust arm 61 are substantially immediately integral along the sliding direction X following the movement of the backrest 3 between the inoperative position A and the reclined position B, as visible in FIG. 7A.

Advantageously, moreover, with the removable hooking system 7 in the unhooking position, the engagement element 70 is placed outside the sliding seat 62 in order to maintain the clearance and release the motion transformation member 60 and the thrust arm 61, as visible in FIG. 7B.

Advantageously, the removable hooking system 7 comprises a lever 71, which is rotatably connected to one between the thrust arm 61 and the motion transformation member 60. In particular, the lever 71 is able to be operated for selectively engaging/disengaging the sliding seat 62 and consequently mechanically connecting together the thrust arm 61 and the motion transformation member 60.

Of course, without departing from the protective scope of the present invention, the removable hooking system 7 can be of linear type, for example providing that the engagement element 70 be movable along a rectilinear direction on order to be inserted within the sliding seat 62, such as for example a pin, which can also be separated and not engaged with the thrust arm 61 or with other components of the adjustment device 5 and be if necessary inserted/disconnected by the user.

Advantageously, the lever 71 is provided with an actuator element 710, manually actuated by a user and rotatably mounted preferably on the thrust arm 61, at a lateral wall of the latter.

Advantageously the lever is also provided with a rotatable arm 711, rotatably connected to the actuator element 710, and at one end of the rotatable arm 711, the engagement element 70 is fixed, preferably integrally attained.

In operation, in the maximum resistance configuration, the lever 71 is advantageously positioned such that the rotatable arm 711 is aligned with the thrust arm 61 along the sliding direction X, and the engagement element 70 engages the sliding seat 62, through the insertion opening made in the enlarged head 611, in order to reduce the clearance within the latter.

In operation, in order to pass from the maximum resistance configuration to the minimum resistance configuration, a user rotates the actuator element 710 and misaligns the rotatable arm 711 with respect to the thrust arm 61, freeing the engagement element 70 from the sliding seat 62. Advantageously, the adjustment device 5 comprises a stop system, which allows constraining the removable hooking system 7 in a pre-established position (for engagement or release) in order to prevent the user from changing the configuration of the adjustment device 5 in an accidental manner.

Advantageously, the stop system comprises a first stop element, preferably fixed to the thrust arm 61, and a second stop element, preferably fixed to the removable hooking system 7, and such two stop elements are mechanically engageable with each other. In particular, the two stop elements are of snap-engageable type.

Preferably, the first stop element is made on the lateral wall of the thrust arm 61, while the secondo stop element is made on the rotatable arm 711. Still more preferably, the two stop elements laterally project from the respective thrust arms 61 and rotatable arm 71, have a tooth shape and are configured in a manner such to be snap-engaged following the movement of the rotatable arm 711 around the axis thereof during the movement of the engagement element 70 between the hooking position and the unhooking position.

The invention thus described therefore attains the pre-established objects.

The contents of the Italian patent application number 102023000013479, from which this application claims priority, are incorporated herein by reference.

The invention claimed is:

1. A chair for the sitting of a user, said chair comprising:

a support structure (2), which is intended to be placed on the ground and to support a user in a seated position;

a backrest (3), which is hinged to said support structure (2), around a first hinging axis (R), and is reclinable around said first hinging axis (R) between an inoperative position (A) and at least one reclined position (B);

an elastic return system (4) comprising a spring (40), which extends between a first end (40') mechanically connected to said backrest (3) and a second end (40") mechanically connected to said support structure (2);

said spring (40) being arranged to be tensioned, at said first end (40'), along a tensioning direction (T) in a first direction (V1), following a movement of said backrest (3), and to exert a corresponding elastic return force, for returning said backrest (3) from said at least one reclined position (B) to said inoperative position (A);

an adjustment device (5), which is mechanically connected to said backrest (3) and to said support structure (2), is adapted to adjust the corresponding elastic return force exerted by said spring (40), and comprises an actuation system (6), which is mechanically connected to said backrest (3) and is removably connectable to the second end (40") of said spring (40);

said actuation system (6) being configured to tension, following the movement of said backrest (3), said spring (40) at said second end (40") along said tensioning direction (T) in a second direction (V2) opposite said first direction (V1), to increase the corresponding elastic return force exerted by said spring (40) due to the movement of said backrest (3) from said inoperative position (A) towards said at least one reclined position (B).

2. The chair of claim 1, wherein said adjustment devices (5) is configured to operate in:

a maximum resistance configuration, in which the second end (40") of said spring (40) is tensionable to exert a greater said corresponding elastic return force;

a minimum resistance configuration, in which the second end (40") of said spring (40) is fixed to exert a lesser said corresponding elastic return force.

3. The chair of claim 2, wherein said adjustment device (5) comprises a removable hooking system (7), which is connected to said actuation system (6) and is movable between a hooking position, in which said removable hooking system (7) is placed as a connection between the second end (40") of said spring (40) and said backrest (3), and an unhooking position, in which said removable hooking system (7) mechanically unhooks the second end (40") of said spring (40) from said backrest (3).

4. The chair of claim 1, wherein said actuation system (6) comprises a motion transformation element (60) arranged as mechanical connection between said backrest (3) and the second end (40") of the spring (40);

said motion transformation element (60) being configured to transform a rotation of said backrest (3) around said first hinging axis (R) into a rectilinear motion of the second end (40") of said spring (40) along said tensioning direction (T).

5. The chair of claim 4, wherein said motion transformation element (60) is rotatably pivoted on said support structure (2) around a rotation axis (Z) substantially orthogonal to said tensioning direction (T) and to said first hinging axis (R).

6. The chair of claim 5, wherein said motion transformation element (60) is pivoted on said support structure (2) at a hinging point (M) and comprises a first arm (60'), which extends between said hinging point (M) and said thrust arm (61), and a second arm (60"), which extends between said hinging point (M) and the second end (40") of said spring (40);

said first arm (60') being provided with a greater extension with respect to said second arm (60"), to determine a sliding of the second end (40") of said spring (40) along said tensioning direction (T) less than the sliding of said thrust arm (61) along said sliding direction (X).

7. The chair of claim 5, wherein said removable hooking system (7) comprises a lever (71), which is rotatably connected to one of said thrust arm (61) and said motion transformation element (60), and is able to be operated to mutually mechanically fix said thrust arm (61) to said motion transformation element (60) at said sliding seat (62).

8. The chair of claim 4, wherein said actuation system (6) comprises a thrust arm (61), which is mechanically connected to said backrest (3) and is slidable along a sliding direction (X) substantially parallel to the tensioning direction (T) of said spring (40) following the rotation of said backrest (3);

said thrust arm (61) being able to be mechanically constrained to said motion transformation element (60) to tension the second end (40") of said spring (40) through said motion transformation element (60).

9. The chair of claim 8, wherein one of said thrust arm (61) and said motion transformation element (60) is provided with a sliding seat (62), and the other of said thrust arm (61) and said motion transformation element (60) is slidably inserted—with clearance—in said sliding seat (62), at least with said adjustment device (5) in said minimum resistance configuration;

said clearance extending parallel to said sliding direction (X) and being configured to allow a free sliding of one of said thrust arm (61) and said motion transformation element (60) in said sliding seat (62) when said backrest (3) is rotated between said inoperative position and said reclined position.

10. The chair of claim 9, wherein said removable hooking system (7) comprises an engagement element (70), and wherein:

with said removable hooking system (7) in said hooking position, said engagement element (70) is placed at least partly in said sliding seat (62) to reduce said clearance and constrain said motion transformation element (60) and said thrust arm (61);

with said removable hooking system (7) in said unhooking position, said engagement element (70) is placed outside said sliding seat (62) to maintain said clearance and release said motion transformation element (60) and said thrust arm (61).

* * * * *